US006107967A

United States Patent [19]

Hill

[11] Patent Number: 6,107,967

[45] Date of Patent: Aug. 22, 2000

[54] BILLBOARD ANTENNA

[75] Inventor: Robert Hill, Fremont, Calif.

[73] Assignee: Wireless Access, Inc., Santa Clara, Calif.

[21] Appl. No.: 09/124,461

[22] Filed: Jul. 28, 1998

[51] Int. Cl.[7] ..... H01Q 1/24

[52] U.S. Cl. ..... 343/702; 343/700 MS; 343/795

[58] Field of Search ..... 343/700 MS, 702, 343/846, 848, 795, 895

[56] References Cited

U.S. PATENT DOCUMENTS

| | | | |
|---|---|---|---|
| 5,646,633 | 7/1997 | Dahlberg | 343/700 MS |
| 5,844,525 | 12/1998 | Hayes et al. | 343/702 |
| 5,892,483 | 4/1999 | Hayes et al. | 343/702 |
| 5,936,587 | 8/1999 | Gudilev et al. | 343/752 |
| 5,949,383 | 9/1999 | Hayes et al. | 343/795 |

*Primary Examiner*—Tan Ho
*Attorney, Agent, or Firm*—Blakely, Sokoloff, Taylor & Zafman LLP

[57] ABSTRACT

A small antenna comprising an unequal current density center-fed dipole employing a conductive trace and a ground plane counterpoise positioned substantially perpendicular to each other. According to one embodiment, a conductive trace is etched onto a dielectric substrate to form a printed circuit. According to a further embodiment, the conductive trace has two sets of orthogonal components; one set of components captures the desired electric field polarization and the second set of components cancels out the undesired cross polarization. A portion of a signal received on the first set of components adds together to produce a desired resultant vector and a portion of the signal received on the second set of components adds together to cancel out the undesired vector.

18 Claims, 13 Drawing Sheets

| MEASURED DATA | |
|---|---|
| AZIMUTH | dBi |
| 0 | -12.0 |
| 45 | -16.0 |
| 90 | -14.5 |
| 135 | -15.0 |
| 180 | -11.0 |
| 225 | -5.0 |
| 270 | -4.0 |
| 315 | -6.0 |
| AVERAGE: | -10.4 |

| | |
|---|---|
| POLARIZATION: | VERTICAL |
| FREQUENCY: | 940 MHz |
| TESTED BY: | R HILL |
| TEST DATE: | 4-FEB-97 |
| METHOD: | HP8753 |
| COMMENTS: | FREE SPACE TEST |
| DEVICE: | LOOP ANTENNA |
| SN: | LOOP STANDAR #1 |
| ORIENTATION: | POSITION 3: STANDING |

| MEASURED DATA | |
|---|---|
| AZIMUTH | dBi |
| 0 | -1.2 |
| 45 | -1.1 |
| 90 | -1.0 |
| 135 | -1.6 |
| 180 | -1.8 |
| 225 | -2.2 |
| 270 | -2.1 |
| 315 | -2.0 |
| AVERAGE: | -1.6 |

| | |
|---|---|
| POLARIZATION: | VERTICAL |
| FREQUENCY: | 940 MHz |
| TESTED BY: | R HILL |
| TEST DATE: | 10-FEB-97 |
| METHOD: | HP8753 |
| COMMENTS: | FREE SPACE TEST |
| DEVICE: | BILLBOARD ANTENNA |
| SN: | PROTOTYPE #5 |
| ORIENTATION: | POSITION 3: STANDING |

BILLBOARD ANTENNA

FIELD OF THE INVENTION

The present invention relates generally to an antenna for transmitting and/or receiving electromagnetic radiation, and more specifically to an antenna for paging devices.

BACKGROUND OF THE INVENTION

Antennas for VHF/UHF hand-held portable equipment, such as pagers, portable telephones and transceivers, must naturally be small in size, light in weight, and compact in structure. Nevertheless, there is a growing tendency for portable equipment to be made continuously smaller as the demand for mobile communication rapidly increases. Consequently, there has become an increasing demand for antennas that are suitable for increasingly smaller portable equipment.

It is well known in classical antenna theory that antenna dimensions are related to the wavelength of the antenna's resonant frequency. It is also well known that the antenna's electrical performance degrades as its dimensions become physically small when compared to its wavelength. Therefore, requirements on antenna performance are becoming increasingly severe in order to place resonant antennas in smaller and smaller packages while avoiding degraded performance as the antenna size becomes smaller. Because of size restrictions, conventional pager antennas use a tuning circuit in conjunction with a non-resonant antenna element that is very small with respect to the wavelength of the pager receiver frequency.

FIGS. 1*a*–1*c* illustrate a conventional antenna 5 used in many modern pager systems. Antenna 5 includes a ground plane 10, a dielectric substrate 12, and a non-resonant loop 14. Antenna 5 is configured such that ground plane 10 and non-resonant loop 14 are disposed perpendicular to each other with dielectric substrate 12 separating them. Ground plane 10 is a zero voltage potential conductor for antenna 5 which serves as an electrically conducting plane. Non-resonant loop 14 functions as a conductive element for antenna 5 that receives electromagnetic waves. Ground plane 10 and non-resonant loop 14 are typically connected to the ground potential (zero volts) and the desired incoming signal line, respectively, of the receiver circuitry (not shown).

Most pager systems are oriented to receive signals from a base station transmitting signals of vertical polarization. Polarization refers to the orientation in space of the electric field vector of an electromagnetic wave as received or radiated from an antenna. If both an antenna and base station have the same polarization, a match occurs (i.e., signals are received). Cross-polarization occurs, however, if an antenna and base station do not have the same polarization (e.g., base station has vertical polarization and antenna has horizontal polarization). If cross-polarization occurs, most of the transmitter antenna's signal will be undetected by the receive antenna.

All parts of antenna 5 must be made as small as possible in order to fit into a pager. Because of such size restrictions, non-resonant loop 14 may be very small with respect to the wavelength of the receiver circuitry tuned frequency. For example, antenna 5 may be required to be as small as one twentieth of a wavelength for some applications. However, classical antenna theory states that antennas work best when their dimensions are an appreciable portion of a wavelength; most antennas require a size ranging from one fourth to one half of the wavelength at the frequency of interest. Thus, an antenna as small as antenna 5 is an inefficient radiator that suffers poor input impedance and low radiation resistance.

Considering that antenna 5 is an inefficient non-resonant radiator, matching circuit components must be added in order for antenna 5 to receive the desired frequency. Coupling a matching circuit to antenna 5 exceedingly suppresses the frequency bandwidth (i.e., the frequency range over which operation is satisfactory). Matching circuit components limit the bandwidth as they tune antenna 5 to one frequency only. As a result of requiring a matching circuit, conventional pager systems have very low bandwidth frequencies.

The addition of a matching circuit also limits the gain of conventional antennas such as antenna 5. The gain is limited in antenna 5 by the absorption of some of the received energy by the matching circuit before it can be passed on to the receiver circuitry. Furthermore, the small physical size of antenna 5 yields a small energy capture area for electromagnetic waves. Due to the minimal gain of antenna 5, a pager must remain within a close distance of a base station in order to receive signals. Consequently, an abundant number of base stations are required to efficiently operate a network of pagers.

Further, in conventional antennas, the operating frequency may be changed by small changes in the physical materials of the antenna and by small changes in the matching circuit components. Thus, if material tolerances of antenna 5 and the matching circuit vary enough from one production lot of pagers to another, each antenna 5 may need to be individually tuned to ensure that the pager will receive the desired frequency. Having to retune each pager causes an increase in both manufacturing time and expense.

FIG. 2 is a plot of the frequency-gain-bandpass amplitude response for antenna 5. The plot represents the gains and frequencies at which antenna 5 operates. Gain represents the ratio of power density radiated by an antenna in a specific direction as compared to an isotropic antenna which radiates energy in all directions equally. Thus, at a given frequency, the higher the amplitude response the easier an electromagnetic signal is received by antenna 5 at that frequency. The number 1 on the plot represents a designed frequency (i.e., frequency of interest) of 940 MHz. The gain at this frequency is −4 dBi (4 dB below the gain of an isotropic radiator) at which antenna 5 is tuned. The numbers 2 and 3 represent the lowest and highest frequencies, respectively, at which antenna 5 has an amplitude response that is 3 dB below the design frequency. Antenna 5 will not efficiently receive electromagnetic waves at frequencies outside of this region. As the frequency is displaced from the design frequency, the performance of antenna 5 is greatly reduced. For example, antenna 5 has an frequency bandpass amplitude response spanning 20 MHz before the response falls below 3 dB of the maximum amplitude response (930 MHz and 950 MHz at −7 dBi). Accordingly, antenna 5 will not operate if the frequency is negligibly varied and outside of this 20 MHz span.

FIG. 2*a* is a polar plot of the amplitude response of antenna 5 to vertically polarized electromagnetic fields with respect to direction at the design frequency. In FIG. 2*a*, the further the response is from the center of the plot, the higher the amplitude gain of antenna 5 in that direction; hence, the easier antenna 5 will receive electromagnetic waves in that direction. Ideally, antenna 5 would have an equal response at every angle; this would indicate that the pager would receive signals from the base station equally well, no matter what direction the base station is at with respect to the pager.

From FIG. 2*a,* it is apparent that the pager will receive signals easily at an azimuth angle of 270 degrees, but will have difficulty if the base station is located at 90 degrees azimuth.

Thus, what is needed is a pager antenna that overcomes the deficiencies and problems described above.

SUMMARY OF THE INVENTION

An antenna includes an unequal current density center-fed dipole employing a conductive trace and a ground plane counter-poise. The ground plane is positioned substantially perpendicular to the conductive trace. According to one embodiment, the conductive trace is etched onto a dielectric substrate to form a printed circuit.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

DETAILED DESCRIPTION OF THE PRESENT INVENTION

Figure 1A:
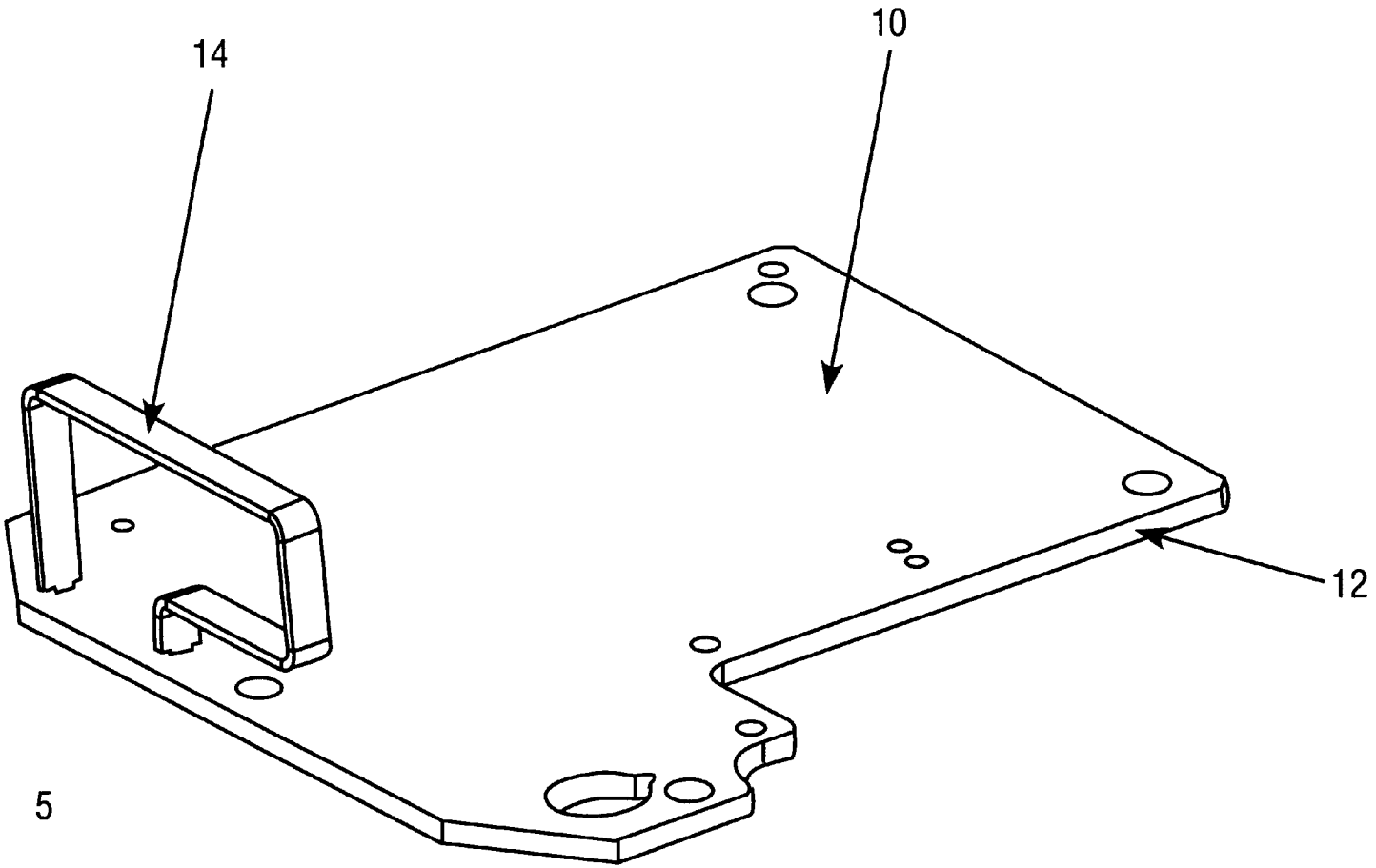
FIG. 1A (PRIOR ART)
FIG. 1*a* illustrates an isometric view of a portable radio antenna according to the prior art.
Figure 1B:
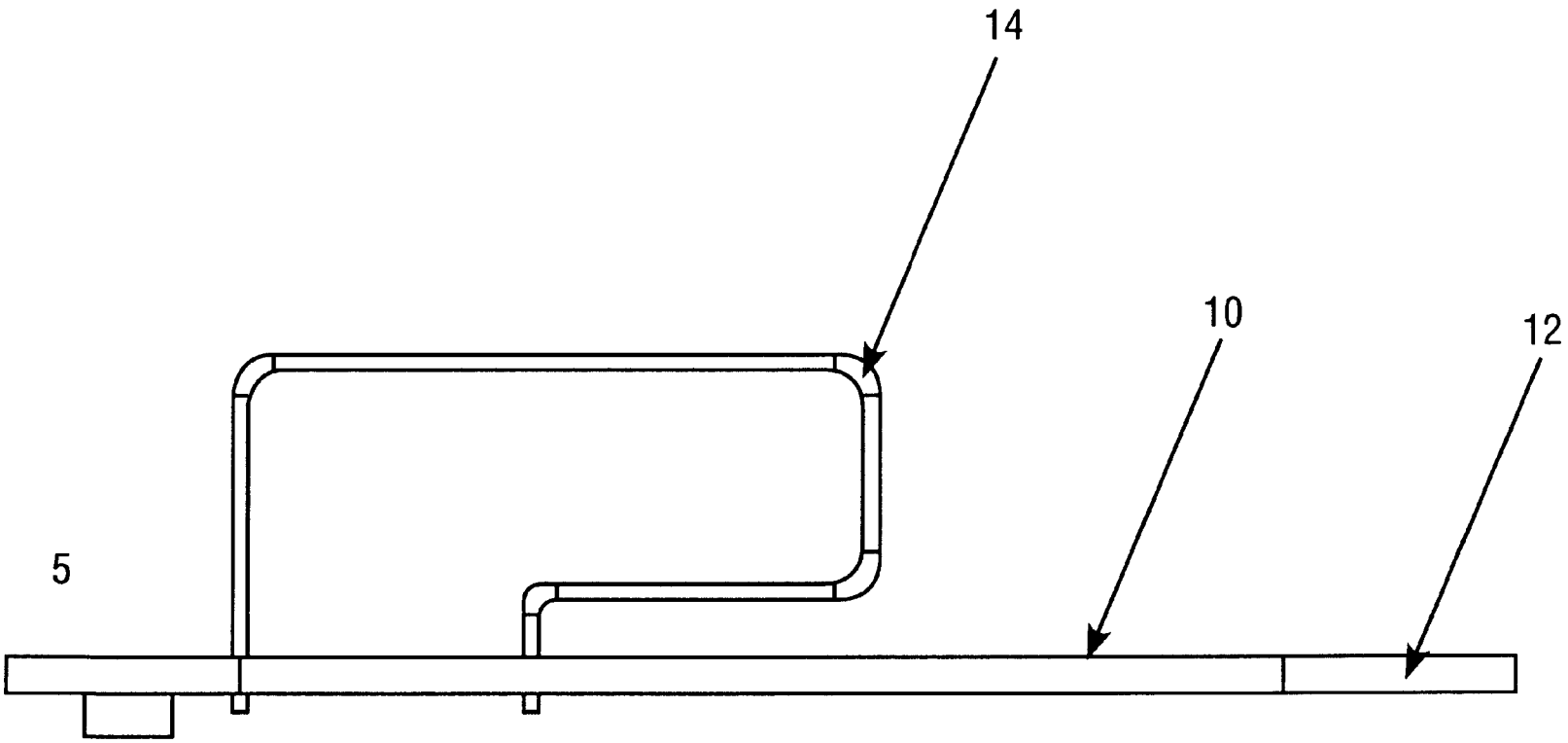
FIG. 1B (PRIOR ART)
FIG. 1*b* illustrates a top view of the prior art portable radio antenna.
Figure 1C:
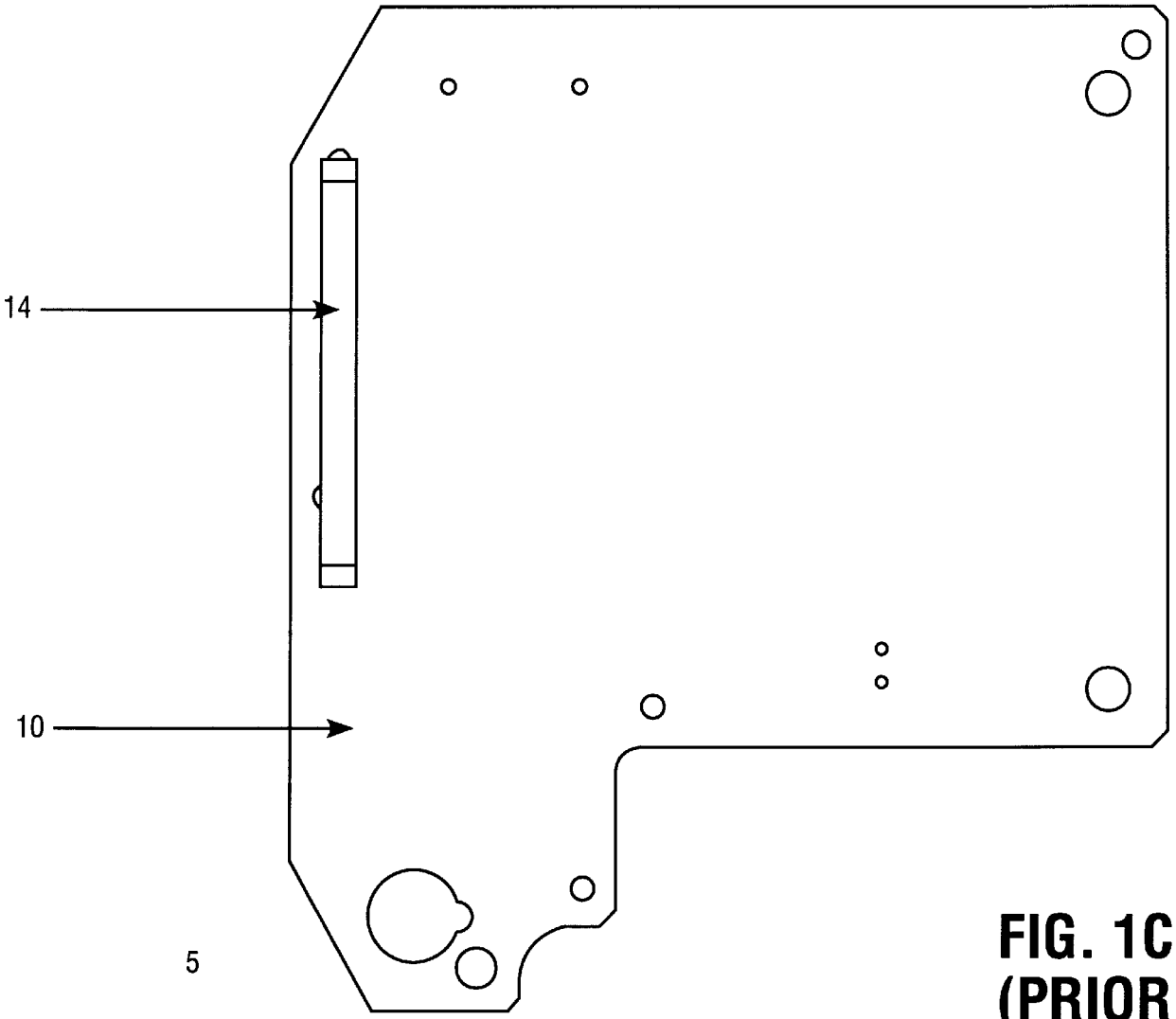
FIG. 1C (PRIOR ART)
FIG. 1*c* illustrates a side view of the prior art portable radio antenna.
Figure 2:
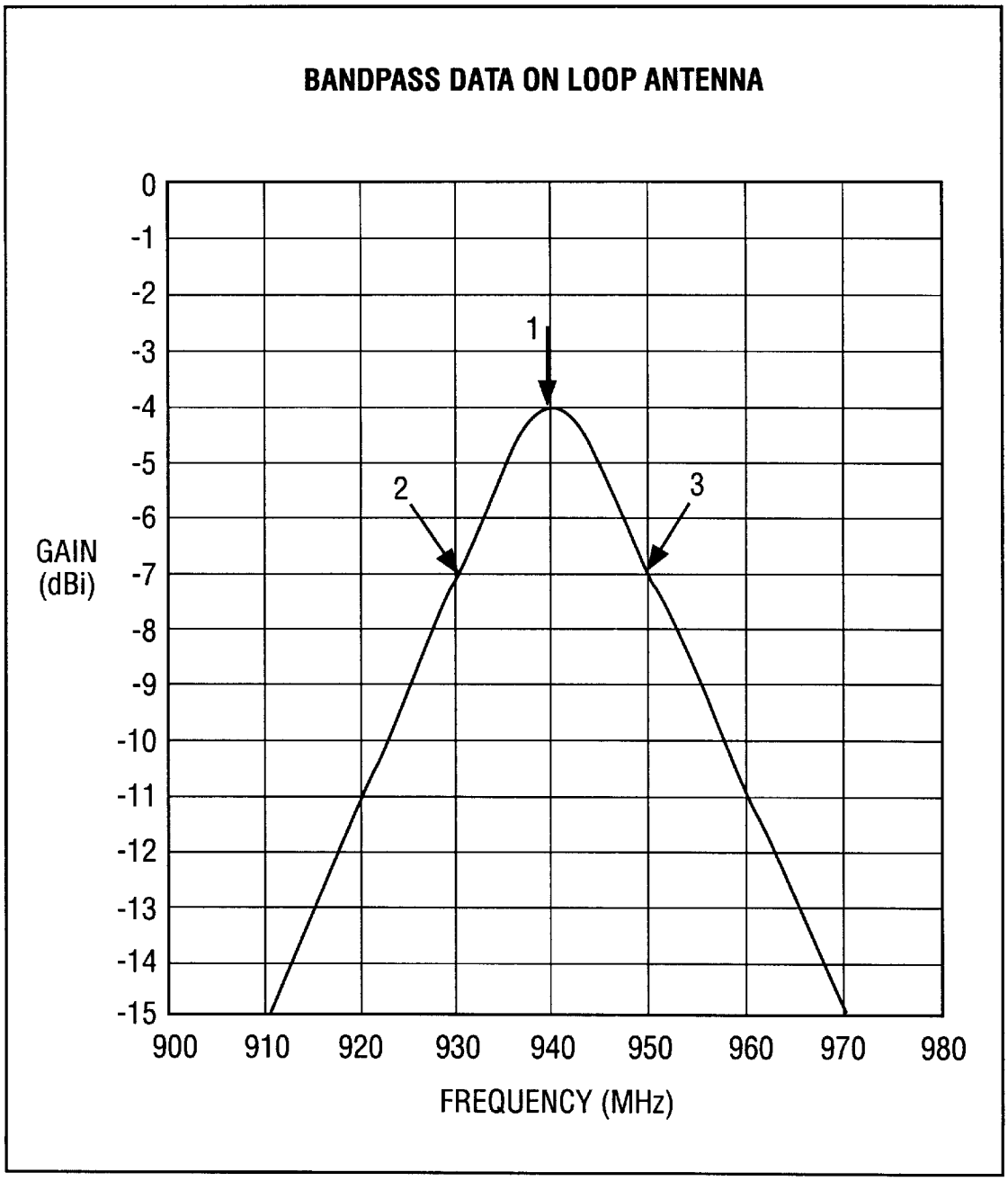
FIG. 2 (PRIOR ART)
FIG. 2 illustrates a plot of the gain-bandwidth for the prior art portable radio antenna.
Figure 2A:
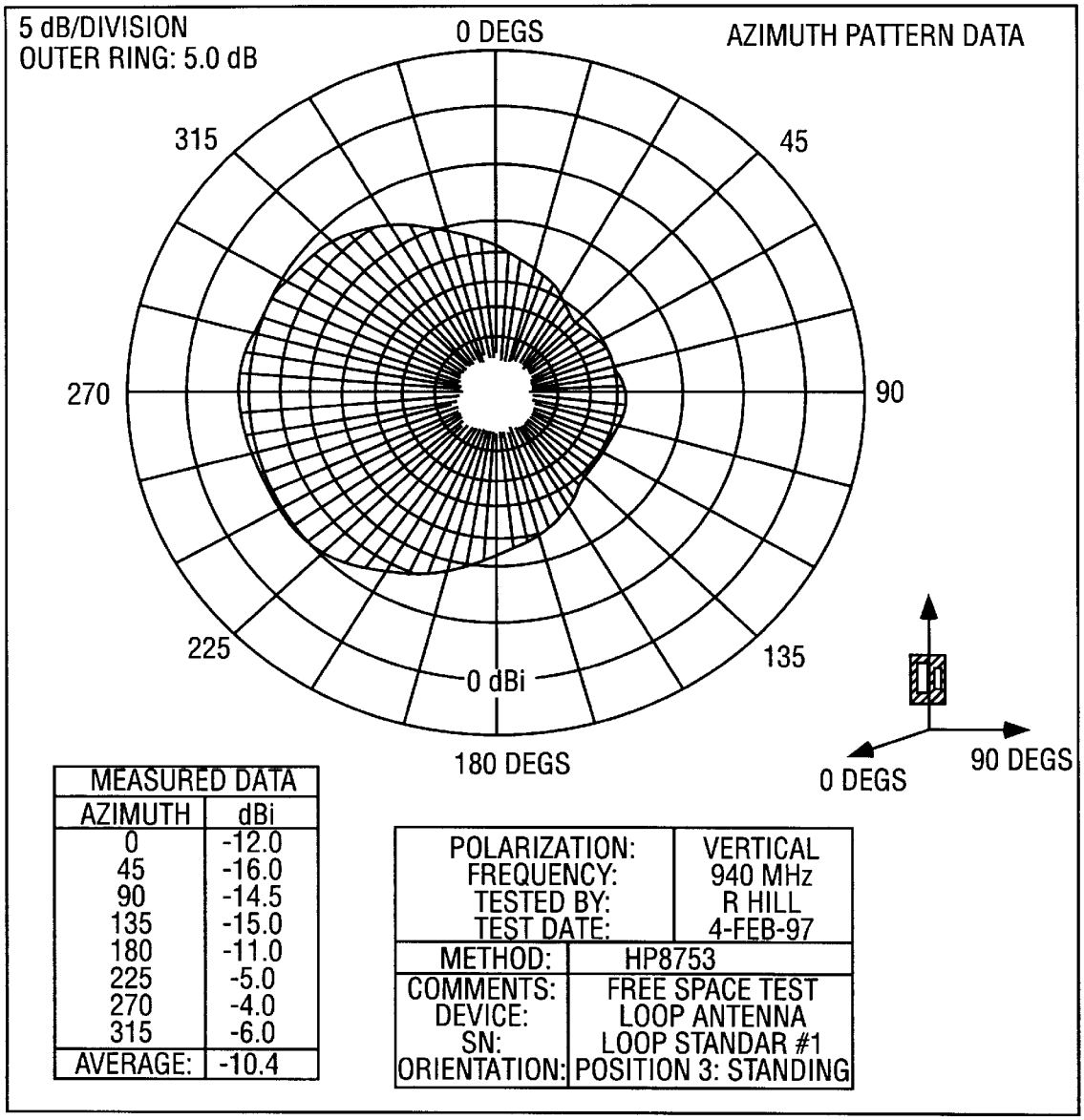
FIG. 2A (PRIOR ART)
FIG. 2*a* illustrates a plot of the radiation pattern for the prior art portable radio antenna.

An antenna is described. In the following description, numerous details are set forth, such as distances between components, types of molding, etc. It will be apparent, however, to one skilled in the art, that the present invention may be practiced without these specific details. In other instances, well-known structures and devices are shown in block diagram form, rather than in detail, in order to avoid obscuring the present invention.

According to the present invention, an antenna includes a conductive trace configured such that all traces oriented in a desired polarization are added together. In addition, all traces oriented in an undesired cross polarization are canceled out. The configuration of the conductive trace enables an antenna with small physical size requirements to achieve the electrical performance of larger, naturally resonant antennas. After reviewing this specification, it will be apparent to those skilled in the art that the present invention may be practiced without some or all of the specific details disclosed herein. In other instances, well known circuit designs and techniques have not been described in detail in order not to unnecessarily obscure the present invention.

FIGS. 3*a*–3*e* illustrate one embodiment of an antenna 100. Antenna 100 may be incorporated in any type of communication device, in particular portable pagers. Antenna 100 includes a motherboard 110, a daughterboard 120, a conductive trace 130, an inner conductor 140 coupled to conductive trace 130, and an outer conductor 150 coupled to the zero voltage ground point of motherboard 110. In one embodiment, the antenna 100 is coupled directly to the receiver circuitry. In a typical application, conductive trace 130 is connected to the signal line of the receiver circuitry on motherboard 110 and is kept isolated (non-contacting) from the zero voltage (ground) potential of motherboard 110. In alternate embodiment, antenna 100 has a connector which connects to a connector of the receiver circuitry.

The zero voltage ground potential of motherboard 110 functions as one-half of antenna 100. According to one embodiment, motherboard 110 is a hexagonal shape and is made of FR4 printed circuit board material having FR4 dielectric material sandwiched between two copper layers. However, in alternative embodiments, motherboard 110 may have other geometric shapes, and may be made up of other conductive materials, such as, for example, gold, silver, platinum, etc.

Daughterboard 120 of antenna 100 is configured to be mounted in a perpendicular position relative to motherboard 110. Daughterboard 120 is a rectangular plate that is made of a low loss dielectric material that has a relative dielectric constant e. According to one embodiment, daughterboard 120 may be made of one-sided GETEK (dielectric constant= 4.20) and may have a surface area of approximately 0.420 square inches. Motherboard 110 may be symmetrical with respect to daughterboard 120. However, motherboard 120 need not be symmetrical with respect to daughterboard 120 in order to practice the present invention. Daughterboard 120 may also be placed near any edge of motherboard 110. In alternative embodiments, dielectric substrate 120 may include different sizes, shapes, as well as dielectric materials. In addition, daughterboard 120 may be placed in alternative positions relative to motherboard 120, but antenna 100 operates with increased performance when daughterboard 120 is placed symmetrical to motherboard 110 and when daughterboard 120 is mounted at the edge of motherboard 110.

Conductive trace 130 is the other half of antenna 100. Conductive trace 130 functions to set up a difference in voltage potential between conductive trace 130 and motherboard 120 for capturing energy from passing electromagnetic waves. The length of conductive trace 130 and the length of motherboard 120 conjunctively determine the frequency that antenna 100 radiates or receives signals. According to one embodiment, conductive trace 130 may be configured such that the design frequency for antenna 100 is 940 MHz. In one embodiment, conductive trace 130 is a copper trace that is etched into one side of daughterboard 120 to form a printed circuit antenna on daughterboard 120. According to a further embodiment, conductive trace 130 may be laid out into six horizontal and six vertical components on daughterboard 120. In one embodiment, the horizontal components are separated by 0.04 inches and the vertical components of conductive trace 130 are separated by 0.4 inches. Nevertheless, in alternative embodiments, the thickness, spacing, and vertical-horizontal configurations of conductive trace 130 may be varied. Further, conductive trace 130 may be made up of other conductive materials, such as, for example, gold, silver, platinum, etc.

Conductive trace 130 may be configured such that all vertically polarized electric field vector components of the electromagnetic wave impinging on the trace add constructively together, while the horizontally polarized electric field components of the electromagnetic wave impinging on the trace destructively cancel each other out. This configuration is desired since the electromagnetic signals from the base station impinging on antenna 100 are vertically polarized. Therefore, the electric field vertical components of the electromagnetic wave energy captured by conductive trace 130 represent the desired polarization, while the horizontal components represent the undesired cross-polarization. This configuration maximizes antenna 100 to receive vertically polarized signals. Consequently, to achieve optimum performance from antenna 100, it is necessary to increase the desired polarization components and reduce the cross-polarization components of trace 130. One of ordinary skill in the art will recognize that the desired polarization of wave propagation may be reversed such that the horizontal components are added together to capture a resultant horizontally polarized electric field vector, while the vertical components cancel each other out.

According to one embodiment, inner conductor 140 and outer conductor 150 may feed conductive trace 130 and motherboard 110 from the edge of motherboard 110 (i.e., edge fed) to form an unequal current density center-fed dipole antenna. In an additional embodiment, inner conductor 140 and outer conductor 150 feed conductive trace 130 and motherboard 110, respectively, from the center of motherboard 110 to form a resonant monopole antenna. However, one skilled in the art will appreciate that various other configurations may be used to feed conductive trace 130 and motherboard 110.

Figure 3A:
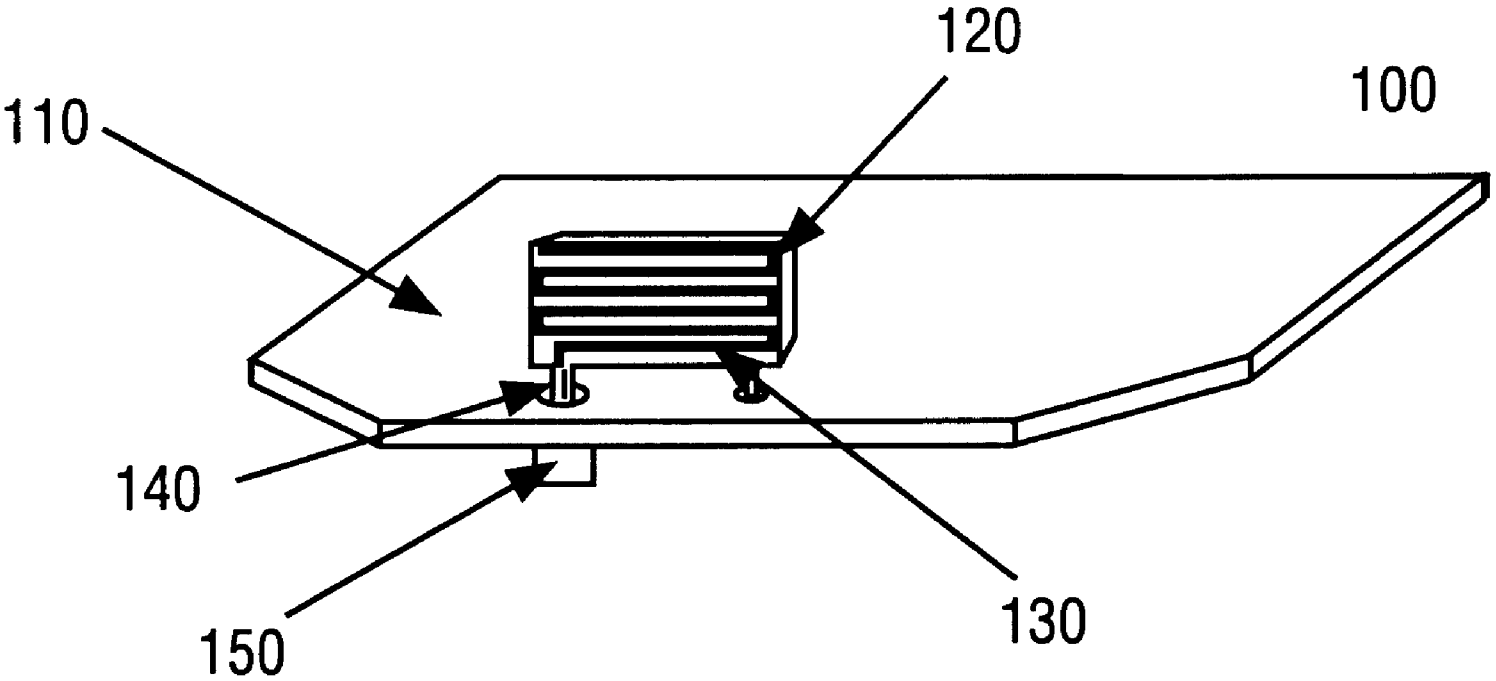
FIG. 3*a* illustrates an isometric view of one embodiment of an antenna.
Figure 3B:
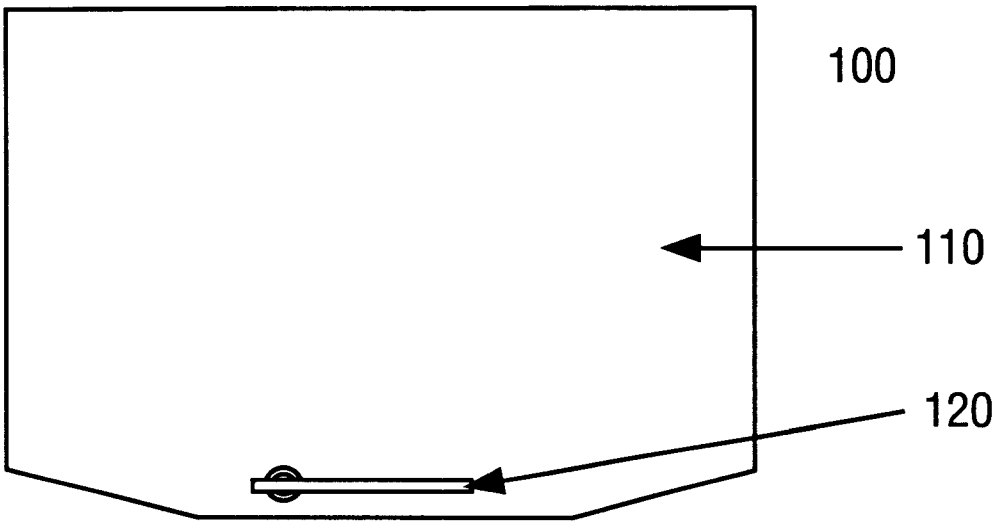
FIG. 3*b* illustrates a top view of one embodiment of an antenna shown in FIG. 3*a;*
Figure 3C:
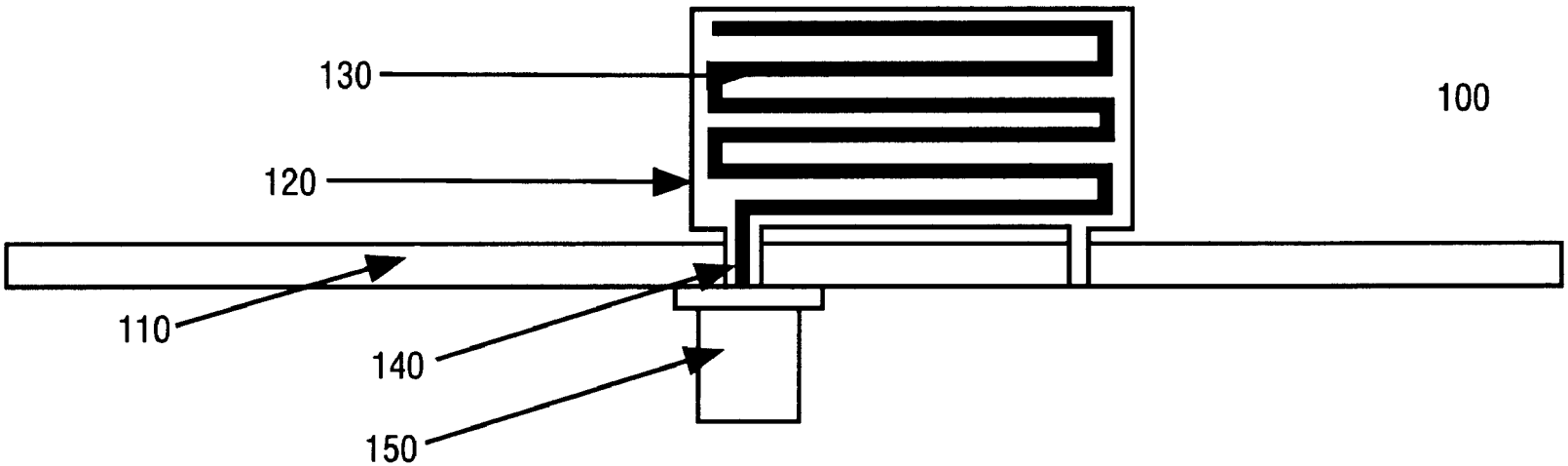
FIG. 3*c* illustrates a front view of the antenna shown in FIG. 3*a;*
Figure 3D:
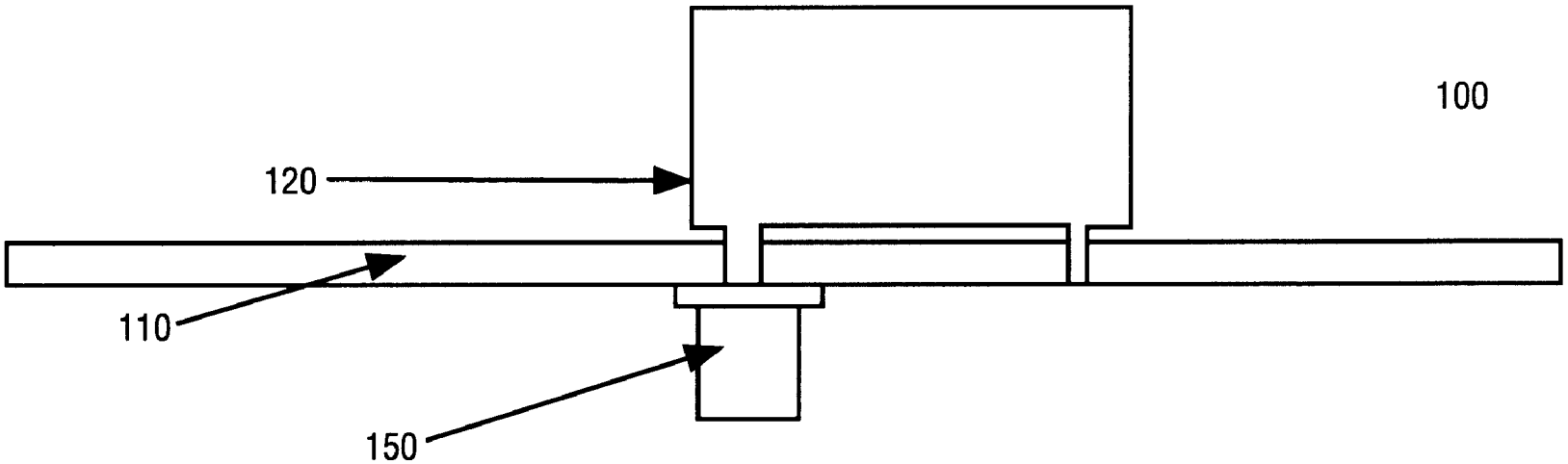
FIG. 3*d* illustrates a back view of the antenna shown in FIG. 3*a;*
Figure 3E:
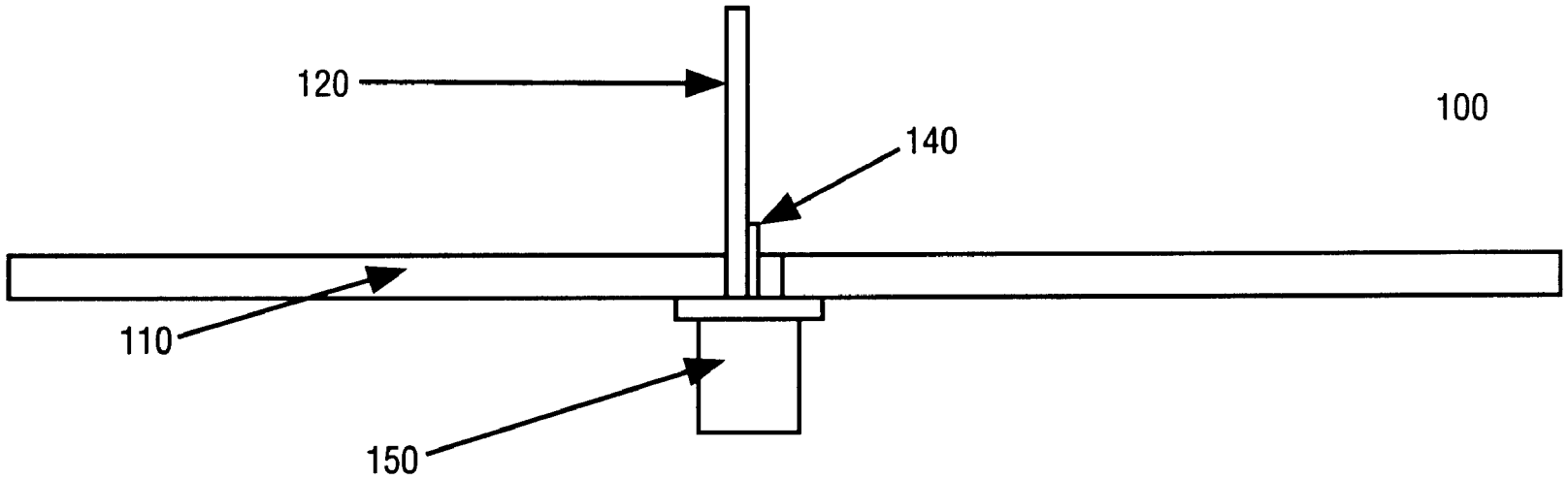
FIG. 3*e* illustrates a side view of the antenna shown in FIG. 3*a;*

FIG. 3*b* illustrates a top view of one embodiment of an antenna shown in FIG. 3*a*. FIG. 3*c* illustrates a front view of the antenna shown in FIG. 3*a*. FIG. 3*d* illustrates a back view of the antenna shown in FIG. 3*a*. FIG. 3*e* illustrates a side view of the antenna shown in FIG. 3*a*.

Figure 4A:
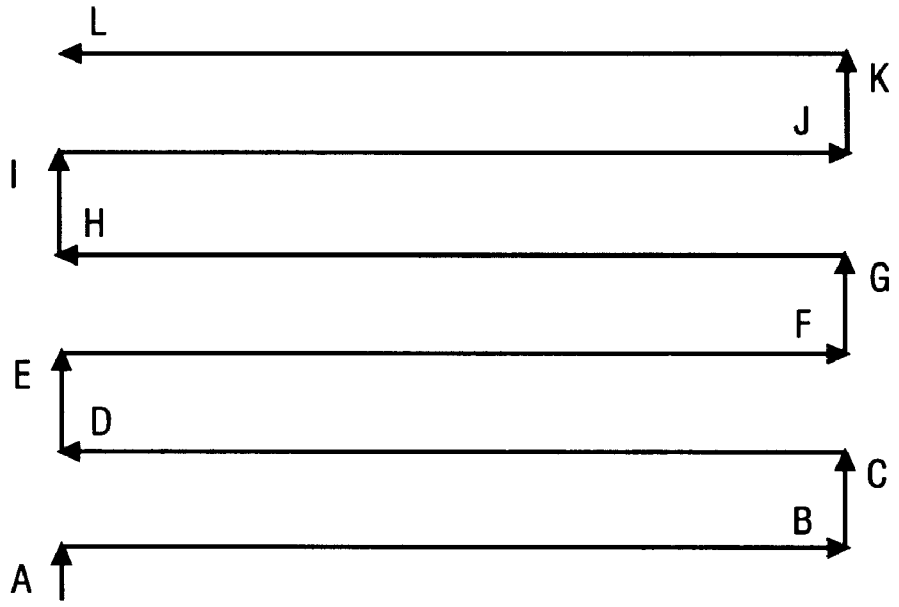
FIG. 4*a* illustrates a conductive trace element for an antenna.

FIG. 4*a* illustrates one embodiment of conductive trace 130. Vertical sectors of conductive trace 130 are represented by vector components a, c, e, g, i and k. Electrical current traverses the vertical components in a vertical direction. Current traversing the vertical components will receive or transmit electromagnetic signals with vertical polarization. The horizontal sectors of conductive trace 130 are represented by vector components b, d, f, h, j and l. Current traversing the horizontal (cross-polarization) components will receive or transmit electromagnetic signals with horizontal polarization. Current traverses horizontal vectors b, f and j from left to right, and vectors d, h and l from right to left. For all current propagating through a horizontal component towards the right, there is an equal amount of current propagating through a horizontal component towards the left (i.e., b=−d, f=−h, j=−l). Consequently, all horizontal vectors cancel out (i.e., b+d+f+h+j+l =0).

Figure 4B:
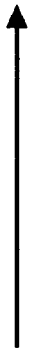
FIG. 4*b* illustrates a resultant electrical vector of the conductive trace.

Since all of the horizontal components of conductive trace 130 are negated, no cross-polarized (horizontal) signals will be radiated or received. Therefore, the resulting vector includes only the sum of the vertical components of conductive tracing 130 (i.e., a+c+e+g+i+k). FIG. 4*b* illustrates the resultant electrical vector of conductive trace 130. It is apparent that conductive trace 130 radiates and/or receive signals only in the desired vertically polarization plane. Accordingly, the signal performance of antenna 100 is optimized.

In alternative embodiments, conductive trace 130 may be configured such that the horizontal components do not completely cancel out. However, vertical polarization reception and radiation efficiency may be reduced because of the energy being extracted by the horizontal component.

Antenna 100 achieves exceptional performance out of reduced space by laying out the geometry of conductive trace 130. The length of conductive trace 130 is laid out to reduce its physical size. However, the electrical performance of conductive tracing 130 may be configured such that antenna 100 is a half wavelength long and naturally resonant at the design frequency. Thus, no matching circuit is required in order for antenna 100 to receive a desired frequency. In addition, antenna 100 has both higher gain and wider frequency bandwidth response than prior art pager antennas because of this natural resonance.

Figure 5:
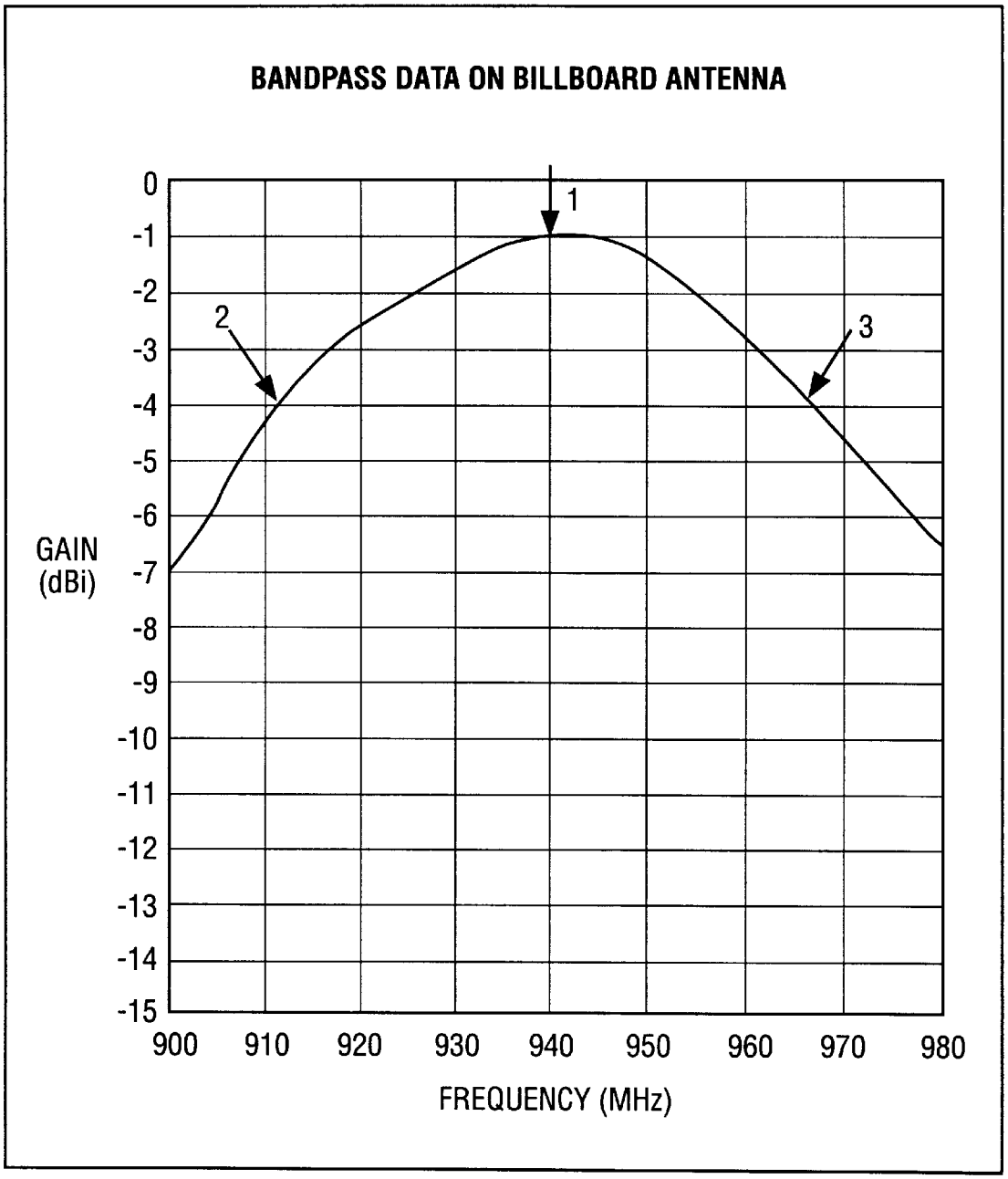
FIG. 5 illustrates a plot of the gain-bandwidth for an antenna described herein.

FIG. 5 illustrates a plot of the gain-bandwidth response for antenna 100. The plot represents the gains and frequencies at which antenna 100 adequately operates. The higher the gain on the plot, the easier an electromagnetic signal is received by or radiated from antenna 100. The number 1 on the plot represents the design frequency of 940 MHz (at −1 dBi) at which antenna 100 is tuned. The numbers 2 and 3 represent the lowest and highest frequencies respectively, at which antenna 100 may operate upon a 3 dB drop off. As the frequency and gain are displaced from the design parameters, the performance of antenna 100 is not reduced. For example, antenna 5 has a span of approximately 55 MHz at a 3 dB drop off of the gain (910 MHz and 965 MHz at −4 dBi).

It is evident that antenna 100 will operate sufficiently if the frequency is varied negligibly. The bandwidth of antenna 100 is broad enough to cover a wide variance of material tolerances that may occur for various production lots. Consequently, pager systems that incorporate antenna 100 do not have to be individually tuned to ensure that the system will receive the desired frequency.

Figure 6:
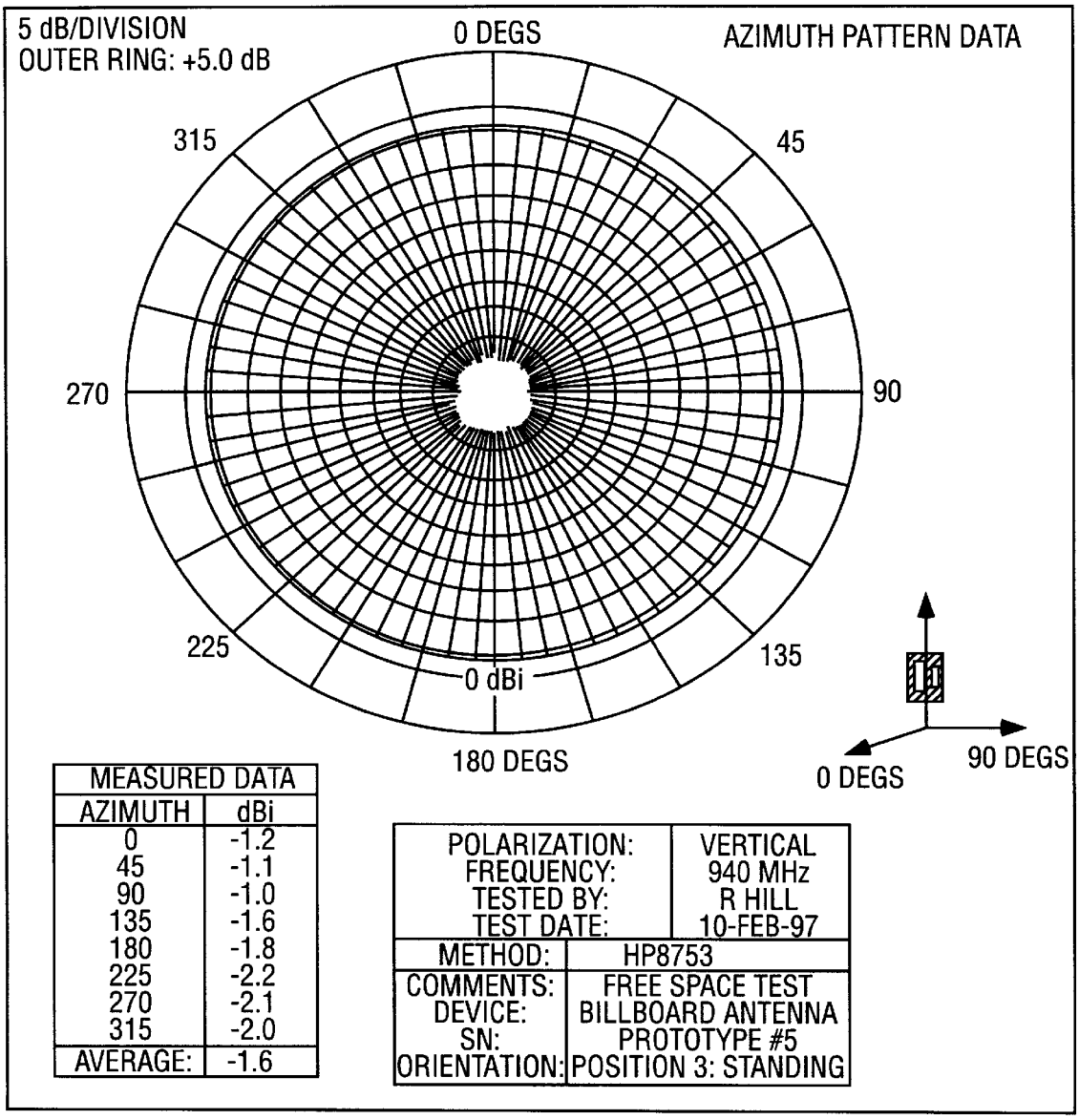
FIG. 6 illustrates a plot of the radiation pattern for an antenna described herein.

FIG. 6 illustrates a plot of the gain response for antenna 100 as a function of direction. The plot represents how well antenna 100 receives vertically polarized signals at each of the azimuth angles from 0 to 360 degrees at the design frequency. From FIG. 6, it is apparent that antenna 100 can receive signals equally well at all of the azimuth angles. Thus antenna 100 is optimized for direction by achieving an omnidirectional response; antenna 100 will receive the vertically polarized signal from the base station no matter what azimuth angle the base station is at with respect to antenna 100.

Furthermore, considering that no matching circuit is required to receive a desired frequency, no energy captured by antenna 100 is absorbed by the matching circuit before it is passed on to the receiver circuitry. Also, since antenna 100 may be configured electrically to have a length of approximately a half wavelength, it yields a sufficient energy capture area for electromagnetic waves. Thus, the gain of antenna 100 is higher than in conventional antennas for pager systems. Due to the higher gain values of antenna 100, the distance between a base station and a pager incorporating antenna 100 may be increased. Accordingly, this would result in reducing the number of base stations that are required to efficiently operate a network.

Although the present invention has been described in terms of preferred embodiments, it will be appreciated that various modifications and alterations might be made by persons skilled in the art without departing from the spirit and scope of the invention. For example, various configurations of vertical and horizontal trace components may be used to achieve results similar to those described above. In addition, the polarization of conductive trace 130 may be modified such that horizontal components are added (i.e., desired polarization) and the vertical components cancel out (i.e., cross-polarization).

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims which in themselves recite only those features regarded as essential to the invention.

Thus, an antenna for use with communication devices has been described.

I claim:

1. An antenna comprising an unequal current density center-fed dipole comprising a conducting trace and a ground plane counterpoise, wherein the conductive trace has first and second sets of components, and wherein a portion of a signal received on the first set of components does not produces a resultant vector and a portion of the signal received on the second set of components produce a resultant vector.

2. The antenna of claim 1, wherein the dipole comprises the conductive trace etched into a printed circuit board (PCB).

3. The antenna of claim 1, wherein the first set of components are parallel to each other and substantially perpendicular to the second set of components.

4. The antenna of claim 3, wherein the resultant electrical vector is a half wavelength at a designed frequency.

5. The antenna of claim 1, wherein the conductive trace is etched into the substrate to form a printed circuit on the substrate.

6. The antenna of claim 5, wherein the conductive trace is etched exclusively into one side of the substrate.

7. The antenna of claim 1, wherein the ground plane is symmetrical with respect to the substrate.

8. The antenna of claim 1, wherein the conductive trace has an electrical net vector of a half-wavelength at a designed frequency.

9. An antenna comprising:

a ground plane counterpoise comprising a conductive material;

a substrate coupled to and positioned with respect to the ground plane; and a conductive trace disposed on the substrate, wherein the substrate is coupled perpendicularly to the ground plane.

10. The antenna of claim 9, wherein the conductive trace has horizontal and vertical components.

11. The antenna of claim 10, further comprising:

a first conductive connector coupled to the conductive trace; and a second conductive connector coupled to the ground plane.

12. The antenna of claim 10, wherein those portions of the signal received on the horizontal components cancel each other out and those portions of the signal received on the vertical components result in the formation of a resultant electrical vector.

13. An antenna comprising:

a first board;

a second board positioned perpendicularly on the first board;

a conductive trace coupled to the second board, wherein the conductive trace has a first and second set of components, and wherein a portion of a signal received on the first set of components does not produce a resultant vector and a portion of the signal received on the second set produces a resultant vector.

14. The antenna of claim 13, further comprising:

a first conductive connector coupled to the conductive trace; and a second conductive connector coupled to the motherboard.

15. The antenna of claim 14, wherein the first board is symmetrical with respect to the second board.

16. The antenna of claim 15, wherein the first board comprises a conductive ground plane.

17. The antenna of claim 16, wherein the second board comprises a dielectric substrate.

18. The antenna of claim 17, wherein the first set of components are parallel to each other and substantially perpendicular to the second set of components.

* * * * *